US006179635B1

(12) United States Patent
Wang

(10) Patent No.: US 6,179,635 B1
(45) Date of Patent: Jan. 30, 2001

(54) ROTARY-CONTROL MEMORY CARD EJECTOR

(75) Inventor: Chihhung Wang, Taipei Hsien (TW)

(73) Assignee: Kinpo Electronics, Inc., Taipei (TW)

( * ) Notice: Under 35 U.S.C. 154(b), the term of this patent shall be extended for 0 days.

(21) Appl. No.: 09/507,752

(22) Filed: Feb. 22, 2000

(51) Int. Cl.[7] ..... H01R 13/62
(52) U.S. Cl. ..... 439/159
(58) Field of Search ..... 439/159, 153, 439/152, 154, 155, 156, 158, 157, 327, 160, 638; 361/686, 687

(56) References Cited

U.S. PATENT DOCUMENTS 5,473,505 * 12/1995 Kessoku et al. ..... 439/159
5,784,253 * 1/2000 Ooka et al. ..... 361/686
5,879,175 * 3/1999 Muramatsu et al. ..... 439/159
5,967,810 * 10/1999 Spickler ..... 439/159
6,010,344 * 1/2000 Muramatsu et al. ..... 439/159

* cited by examiner

*Primary Examiner*—Khiem Nguyen
*Assistant Examiner*—J. F. Duverne
(74) *Attorney, Agent, or Firm*—Bacon & Thomas, PLLC

(57) ABSTRACT

A rotary-control memory card ejector includes a drive wheel turned about a fixed shaft, and an actuating bar having a first end pivoted to an eccentric point at the drive wheel and a second end formed with a stop bar stopped at a front end edge of a memory card inserted into a receptacle in the housing of an apparatus. The inserted memory card is ejected out of the receptacle upon rotary motion of the drive wheel; therefore less operation space is needed to eject the inserted memory card.

6 Claims, 5 Drawing Sheets

ROTARY-CONTROL MEMORY CARD EJECTOR

BACKGROUND OF THE INVENTION (a) Field of the Invention

The present invention relates to a rotary-control memory card ejector, and more particularly to such a rotary memory card ejector for use in an electronic apparatus for the ejection of the loaded memory card, such as SMC, MMC, Compact Flash Card, PCMCIA, etc.

(b) Description of the Prior Art

FIG. 5 shows a digital camera 9 used with a SMC (Smart Media Card) 7. The digital camera 9 comprises a side opening 92, a hinged cover 90 for closing the side opening 92, a receptacle 91 for receiving a SMC 7, and a memory card ejector formed of an ejector button 81, a drive bar 82 and a swivel rod 83. The swivel rod 83 has a free end disposed in contact with one end of the loaded SMC 7. When taking out the loaded SMC 7, the cover 90 is opened, and then the ejector button 81 is depressed to push the drive bar 82 backwards, causing the swivel rod 83 to push the loaded SMC 7 out of the receptacle 91, and the loaded SMC 7 can than be taken out of the digital camera 9 from the side opening 92. This structure of memory card ejector has drawbacks. Because the ejector button 81 and the drive rod 82 are arranged to be moved horizontally within a distance, much installation space should be provided in the digital camera for the memory card ejector. This limitation causes the digital camera unable to be made smaller. Further, because the ejector button 81 protrudes from one side of the digital camera 9 when the memory card bears no load, the protruding part of the ejector button 81 destroys the sense of beauty of the digital camera 9, and the ejector button 81 tends to be vibrated.

SUMMARY OF THE INVENTION

The present invention has been accomplished to provide a memory card ejector, which eliminates the aforesaid drawbacks. It is therefore one object of the present invention to provide a memory card ejector, which requires less operation space. It is another object of the present invention to provide a memory card ejector, which does not vibration during operation. According to one aspect of the present invention, the rotary-control memory card ejector comprises a drive wheel turned about a fixed shaft, the drive wheel having an eccentric point far from the fixed shaft, and an actuating bar having a first end pivoted to the eccentric point at the drive wheel and a second end formed with a stop bar stopped at a front end edge of a memory card inserted into a receptacle in the housing of an apparatus. The inserted memory card is pushed out of the receptacle by the actuating bar upon rotary motion of the drive wheel. According to another aspect of the present invention, a guide structure is provided to guide movement of the actuating bar in pushing the inserted memory card out of the receptacle. According to still another aspect of the present invention, the guide structure comprises a longitudinal sliding slot formed on the actuating bar on the middle, and a fixed guide pin inserted into the longitudinal sliding slot to guide movement of the actuating bar. The guide pin and/or the shaft can be formed on the receptacle, the housing of the apparatus, or any other object capable of keeping the guide pin and the shaft in relative positions. According to still another aspect of the present invention, the drive wheel has a serrated periphery for positive rotation by hand.

DETAILED DESCRIPTION OF THE PREFERRED EMBODIMENTS

Figure 1:
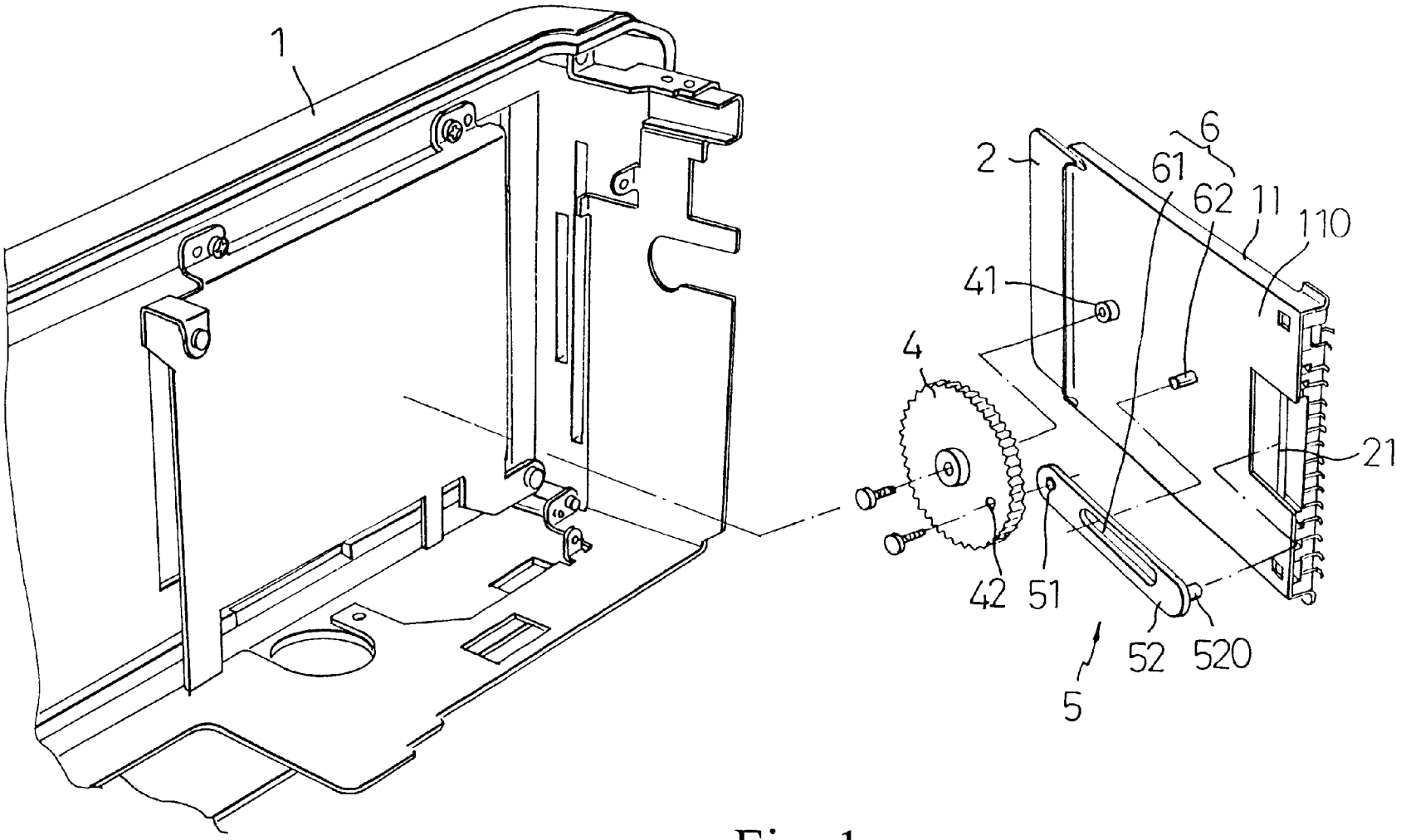
FIG. 1 is an exploded view of a rotary-control memory card ejector according to a first embodiment of the present invention.

FIG. 1 shows a rotary-control memory card ejector for use with a SMC (Smart Media Card) 2. A receptacle 11 is installed in a housing for digital camera 1. The receptacle 11 comprises a top cover shell 110, a shaft 41 and a guide pin 62 respectively raised from the outside wall of the top cover shell 110 thereof on the middle. The shaft 41 and the guide pin 62 are spaced at same elevation at a fixed distance. A peripherally serrated drive wheel 4 is turned about the shaft 41. An actuation bar 5 is coupled to the guide pin 62 and pivoted to the drive wheel 4. The drive wheel 4 and the actuation bar 5 form a rotary-control memory card ejector.

Figure 2:
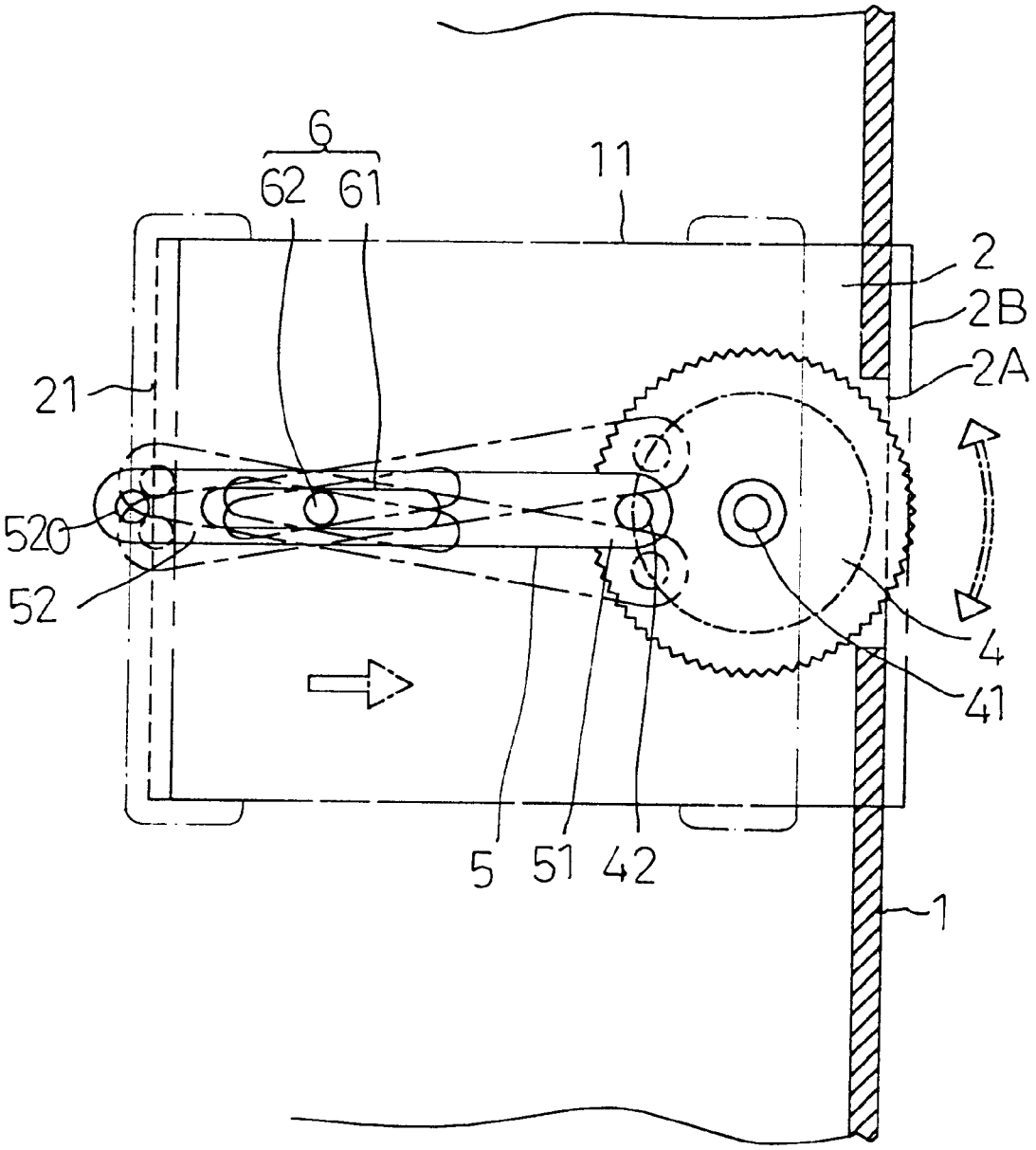
FIG. 2 is a schematic drawing showing the operation of the rotary-control memory card ejector according to the first embodiment of the present invention.

Referring to FIG. 2 and FIG. 1 again, the actuating bar 5 has a first end 51 pivoted to an eccentric point 42 at the drive wheel 4, a longitudinal sliding slot 61 disposed on the middle and coupled to the guide pin 62, a second end 52, and a stop rod 520 perpendicularly raised from the second end 52 and stopped at the front end 21 of the SMC 2 in the receptacle 11. The longitudinal sliding slot 61 and the guide pin 62 form a guide structure 6 to guide movement of the actuating bar 5. Rotating the drive wheel 4 causes the actuating bar 5 to push the SMC 2 from the loading position 2A (where the SMC 2 is received inside the housing for digital camera 1) to the ejected position 2B (where the SMC 2 has a part extended out of an opening on one lateral side wall of the housing for digital camera 1). The aforesaid design enables the user to eject the inserted SMC 2 by rotating the drive wheel 4 in either direction.

Figure 3:
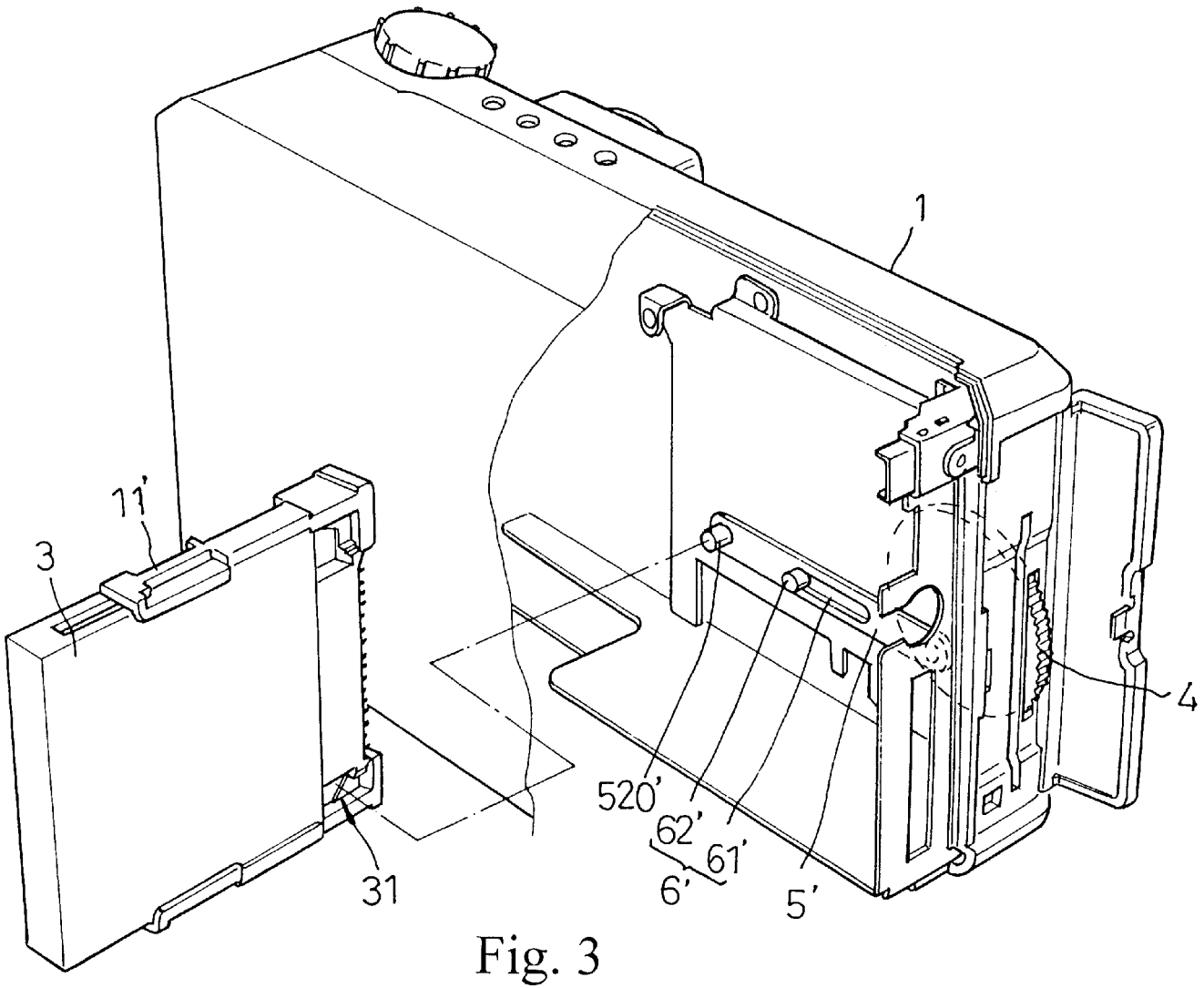
FIG. 3 is an exploded view of a rotary-control memory card ejector according to a second embodiment of the present invention.
Figure 4:
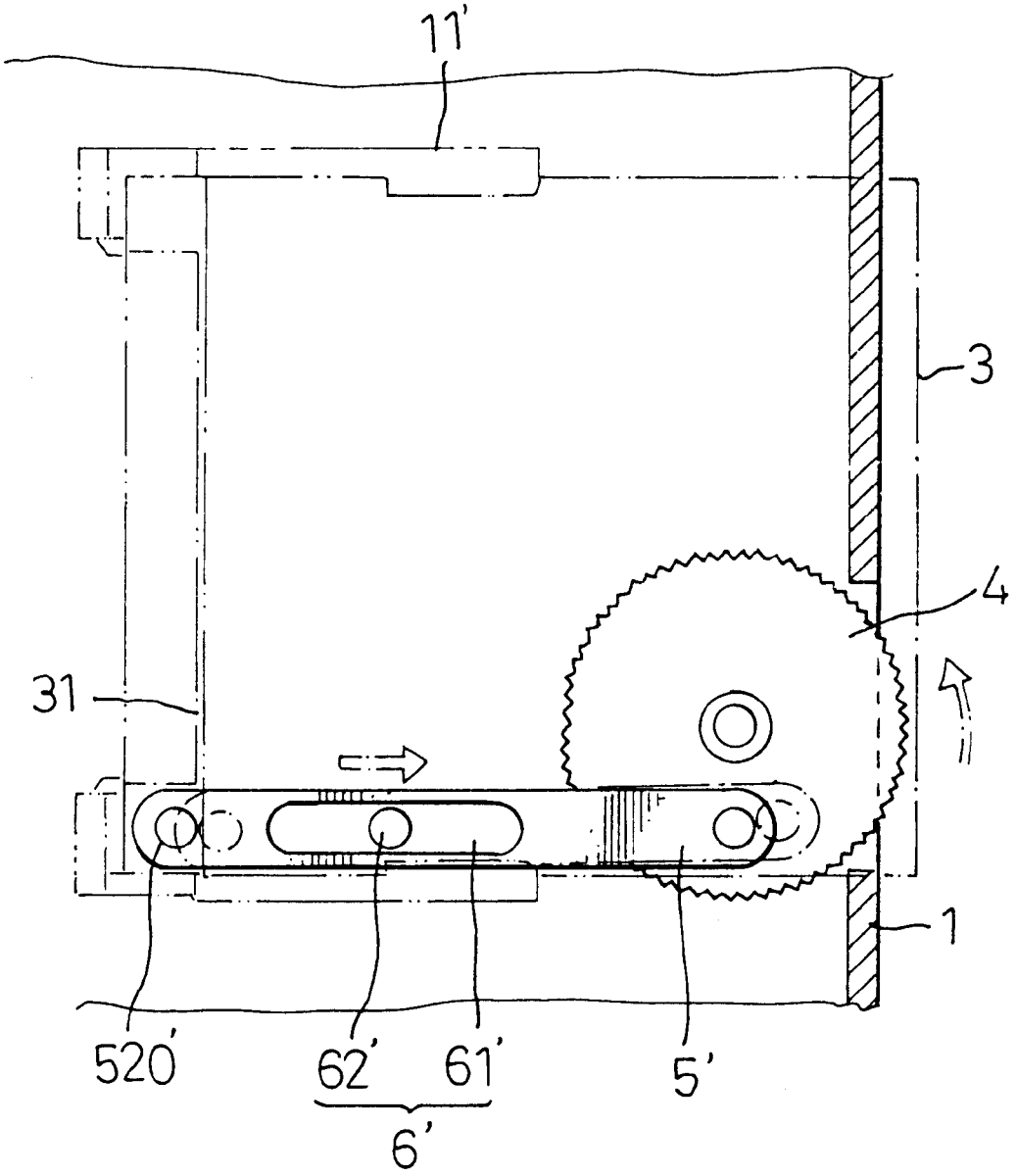
FIG. 4 is a schematic drawing showing the operation of the rotary-control memory card ejector according to the second embodiment of the present invention.
Figure 5:
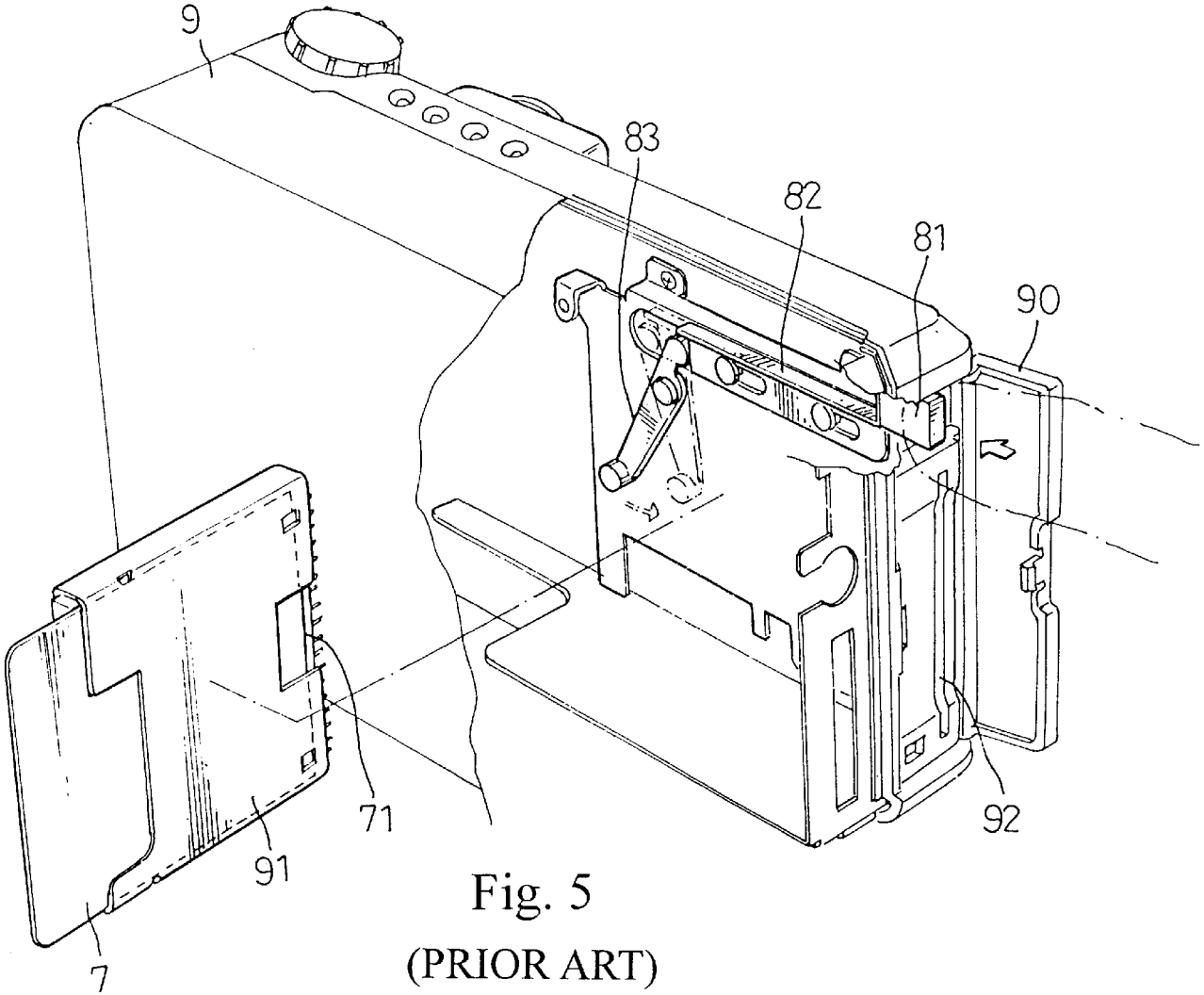
Fig. 5 (PRIOR ART)
FIG. 5 illustrates the operation of a memory card ejector in a digital camera according to the prior art.

FIGS. 3 and 4 show a second embodiment of the present invention. According to this embodiment, the rotary-control memory card ejector is designed for use with a compact flash card 3. The compact flash card 3 is inserted into a receptacle 11' in the housing for digital camera 1. Similar to the first embodiment shown in FIGS. 1 and 2, the second embodiment of the present invention also comprises an actuating bar 5' and a drive wheel 4. The drive wheel 4 is turned about a shaft (not shown) inside the housing for digital camera 1. The actuating bar 5' has a first end pivoted to an eccentric point at the drive wheel 4, a longitudinal sliding slot 61' disposed on the middle and coupled to a guide pin 62' inside the housing for digital camera 1, and a stop rod 520' perpendicularly raised from a second end thereof and stopped at a front end edge 31 of the inserted compact flash card 3. The longitudinal sliding slot 61' and the guide pin 62' form a guide structure 6' to guide movement of the actuating bar 5. Because the sliding slot 61' and guide pin 62' of the guide structure 6' are disposed inside the housing for digital camera 1 at a position biased to one side of the inserted compact flash card 3, the drive wheel 4 works in one direction only.

It is to be understood that the drawings are designed for purposes of illustration only, and are not intended for use as a definition of the limits and scope of the invention disclosed.

What the invention claimed is:

1. A rotary-control memory card ejector installed in an electronic apparatus housing and stopped at a front end edge of a memory card being inserted into a receptacle in said electronic apparatus housing for operation to move the inserted memory card out of said electronic apparatus, said memory card ejector comprising:

a drive wheel turned about a fixed shaft, said drive wheel having an eccentric point far from said fixed shaft; and an elongated actuating bar, said actuating bar comprising a first end pivoted to said eccentric point of said drive wheel, a second end, and a stop rod disposed at said second end and stopped at said front end edge of said memory card being inserted into said receptacle in said electronic apparatus housing for moving said inserted memory card out of said electronic apparatus housing upon rotary motion of said drive wheel.

2. The rotary-control memory card ejector of claim 1 further comprising a guide structure for guiding movement of said actuating bar in moving said inserted memory card out of said electronic apparatus housing.

3. The rotary-control memory card ejector of claim 2 wherein said guide structure comprises a longitudinal sliding slot formed on said actuating bar on the middle, and a fixed guide pin inserted through said longitudinal sliding slot.

4. The rotary-control memory card ejector of claim 3 wherein at least one of said guide pin and said shaft is provided at said receptacle.

5. The rotary-control memory card ejector of claim 3 wherein at least one of said guide pin and said shaft is fixedly provided inside said electronic apparatus housing.

6. The rotary-control memory card ejector of claim 1 wherein said drive wheel has a serrated periphery.

* * * * *